US008490591B1

(12) United States Patent
Perillo

(10) Patent No.: US 8,490,591 B1
(45) Date of Patent: Jul. 23, 2013

(54) VALVE ARRANGEMENT

(75) Inventor: Salvatore Anthony Perillo, Kissimmee, FL (US)

(73) Assignee: Salvatore Anthony Perillo, Kissimmee, FL (US)

( * ) Notice: Subject to any disclaimer, the term of this patent is extended or adjusted under 35 U.S.C. 154(b) by 0 days.

(21) Appl. No.: 13/507,235

(22) Filed: Jun. 14, 2012

(51) Int. Cl.
*F01L 1/04* (2006.01)

(52) U.S. Cl.
USPC ..... 123/90.6; 123/90.24; 123/79 R

(58) Field of Classification Search
USPC ..... 123/90.61, 90.24, 90.6, 79 R
See application file for complete search history.

(56) References Cited

U.S. PATENT DOCUMENTS 5,205,246 A * 4/1993 McWhorter ..... 123/79 R
7,096,838 B1 * 8/2006 Sexton ..... 123/90.6

* cited by examiner

*Primary Examiner* — Zelalem Eshete

(57) ABSTRACT

A valve arrangement for a four-cycle internal combustion engine is described.

Figure 1:
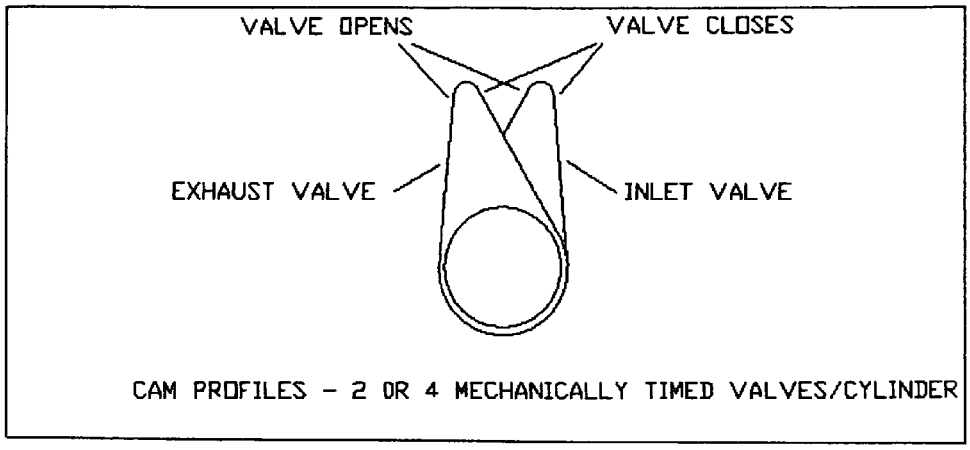

The arrangement includes a single poppet valve mechanically-timed by a unified single lobe cam in such a manner as to be totally dosed during the compression cycle and the power cycle and to be open during the exhaust cycle and the inlet cycle.

During the period when the poppet valve remains open, the correct direction of the combustion gas exiting through the exhaust port and the air charge (direct fuel injected spark engines and compression ignition engines) or fuel/air mixture (indirect fuel injected and carburetted engines) entering through the inlet port is maintained by two passive unidirectional reed valves, preferably located close to the exit from the exhaust port and close to the entrance to the inlet port respectively.

The invention requires substantially fewer mechanically-timed components, delivering key advantages in terms of cost, efficiency and adaptability.

16 Claims, 2 Drawing Sheets

VALVE ARRANGEMENT

The present invention relates to a valve arrangement, and in particular, a valve arrangement for an internal combustion engine.

The use of valves in four-cycle internal combustion engines is a well established and conventional technique for the control of incoming air/fuel mixture and outgoing combustion gases. Historically, lubrication problems associated with alternative valve designs resulted in the poppet valve becoming the preferred valve type, typically with one inlet and one exhaust valve located within the combustion chamber for each cylinder of the engine. The search for improved engine breathing led to larger valves, the higher mass of which resulted in valve float at high rpm, where the larger mass valves, opening and closing in a very short time-cycle caused the valves to lose timing with the cam profile, with consequential engine damage.

Engineering limitations of the two valve system, legislation concerning exhaust emission levels, the need to conserve natural fuel resources, and an on-going search for higher power outputs/efficiencies have all been influential in establishing the four valves per cylinder arrangement which is the current industry standard. The 4-valve arrangement enables greater valve area for better engine breathing and the relatively lightweight valves prevent valve float. Disadvantages of the current 4-valve arrangement are the number of mechanically-timed (active) components within the cylinder head and the energy taken from the crankshaft in order to drive these components. It should be noted that the simpler 2-valve arrangement is still frequently encountered in engines where crankshaft speeds are relatively low, especially in commercial vehicle and industrial engine applications.

The essential function of any four cycle engine valve arrangement is to be open to enable the entry of the air/fuel mixture during the inlet stroke of the piston (cycle 1—downward), be closed to seal the combustion chamber during the subsequent compression stroke (cycle 2—upward) and power stroke (cycle 3—downward), and then to be open to enable expulsion of the combustion gases on the subsequent exhaust stroke (cycle 4—upward). Current established valve arrangements in 2-valve or 4-valve form use separate inlet and exhaust valves, dedicated to the respective function and actuated by separate cam lobes.

The present invention enables a four cycle engine to function in the manner described above by replacement of the separate mechanically-timed (active) inlet and exhaust valves with a single mechanically-timed (active) poppet valve and the introduction of two untimed (passive) unidirectional reed valves. The inlet reed valve, located within the cylinder head close to the jointing face with the inlet manifold, allows passage only in the inlet direction. The exhaust reed valve, located within the cylinder head close to the jointing face with the exhaust manifold, allows passage only in the exhaust direction.

The valve operation is most clearly described by considering the four cycle engine sequence commencing with cycle 2, the compression stroke, and proceeding in the sequence 2-3-4-1. The single mechanically-timed (active) poppet valve closes for the compression stroke of the piston (cycle 2—upward), sealing the combustion chamber, and it remains closed for the power stroke (cycle 3—downward). The valve then opens for the exhaust stroke (cycle 4—upward) and it remains open for the subsequent inlet stroke (cycle 1—downward). During the exhaust cycle, the unidirectional reed valve at the exit from the exhaust port is opened by positive pressure, allowing the combustion gas to be expelled. At the same time, the positive pressure against the inlet reed valve prevents the same combustion gas from blowing out through the inlet port. As the piston descends during the inlet cycle, the unidirectional reed valve at the entrance to the inlet port opens under negative pressure, allowing the air charge (in the case of direct fuel injected spark engines and compression ignition engines) or the fuel/air mixture (in the case of indirect fuel injected and carburetted engines) to be drawn into the engine. At the same time, the negative pressure against the exhaust reed valve prevents combustion gas from being drawn back in through the exhaust port. Preferably, the inlet reed valve is of composite metal and synthetic materials to ensure positive sealing. Preferably, the exhaust reed valve is of all-metal construction to withstand the higher temperatures. Preferably, the passive reed valves are held in place by locking rings and/or circlips. Their location is such that they can be readily serviced or replaced at extended mileage intervals.

Figure 2:
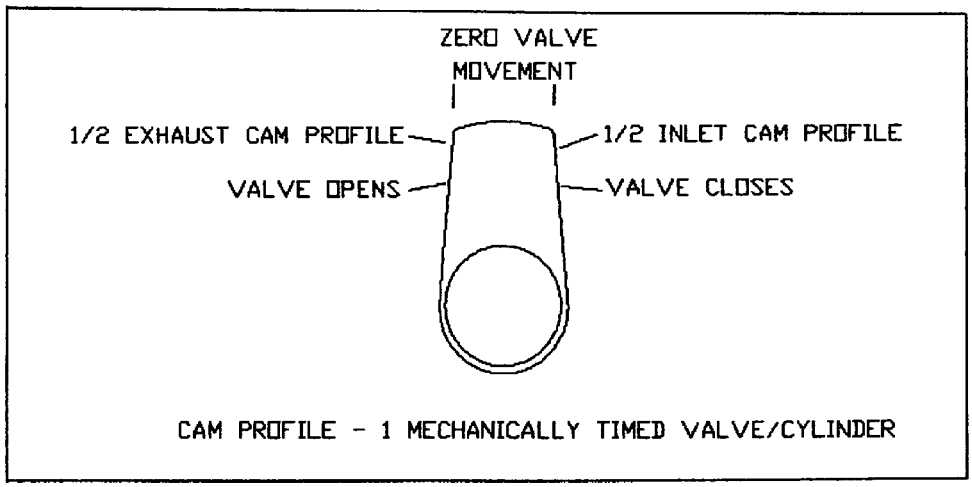

REFERRING TO FIGS. 1 and 2

FIG. 1 illustrates the respective profiles of conventional exhaust and inlet cam lobes. These are drawn on a common axis to demonstrate the relative timing positions of the cam lobes. The flat sides on each cam lobe are indicative of the fast opening and closing characteristics, whilst the sharp peak denotes the extremely short time duration when the valve is fully open. The resulting combination of rapid acceleration with reversal of direction is the prime factor in the incidence of valve float.

FIG. 2 illustrates the profile of the unified cam lobe used in the present invention. The timing for the opening of the single valve is analogous to that of the traditional exhaust valve, being consequential to the first half of the exhaust cam profile. The timing for the closing of the single valve is analogous to that of the traditional inlet valve, being consequential to the second half of the inlet cam profile. During the period of time between these two events the single valve remains stationary in the open position. Although the mass of the large single valve is greater than that of the smaller individual inlet and exhaust valves used in 2-valve or 4-valve arrangements, the timing of the unified cam removes the rapid reversal of direction, thus preventing valve float. The profile for the unified cam lobe is derived from the above requirements.

Figure 3:
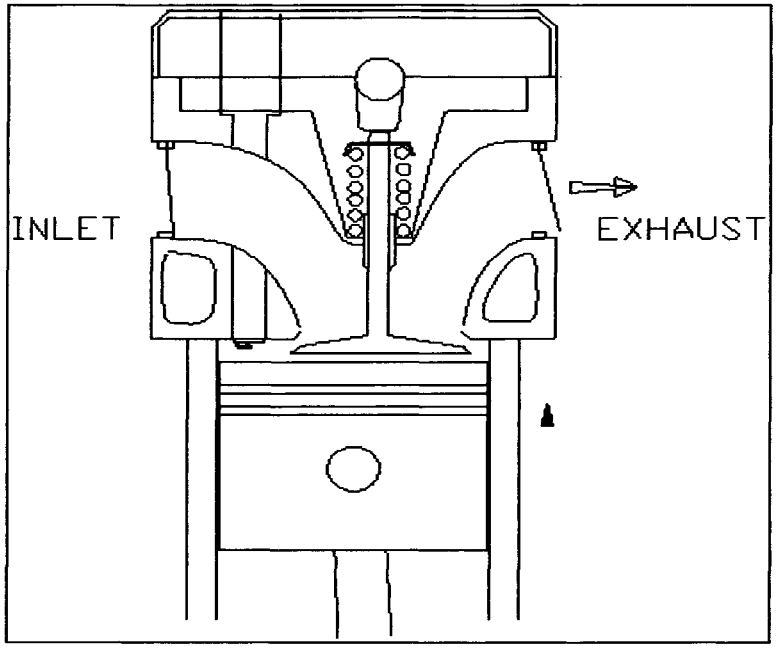
Figure 4:
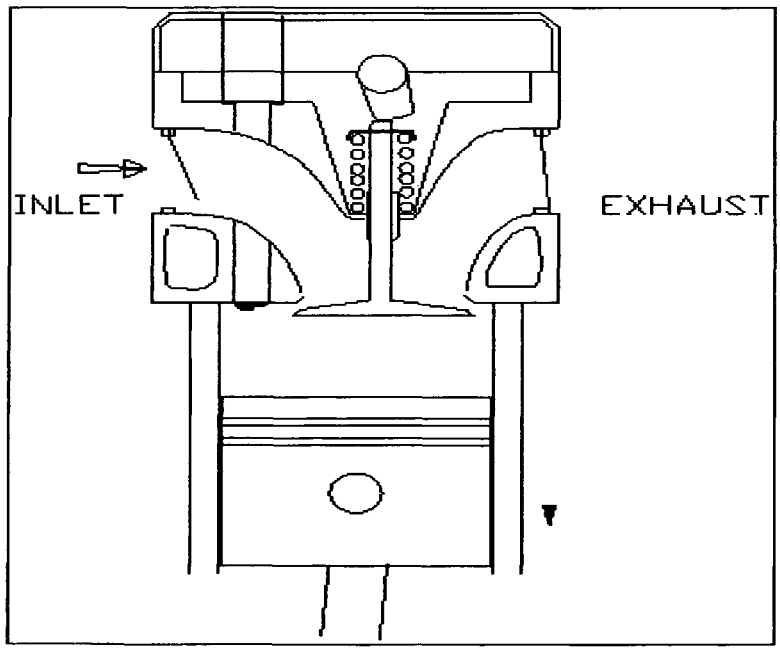

REFERRING TO FIGS. 3 and 4

FIG. 3 indicates the piston approaching TDC on the exhaust cycle. The expulsion of combustion gases is practically complete through the unidirectional exhaust reed valve, the orientation of which is favourable only to the exit direction through the exhaust port. The inlet port is effectively closed by the unidirectional inlet reed valve, the orientation of which is favourable only to the entry direction of the inlet charge when the piston descends. The single poppet valve is open throughout this (exhaust) cycle and will remain open during the following inlet cycle (see below).

FIG. 4 indicates the piston descending to BDC on the inlet cycle. The intake of air/fuel is almost complete, drawn into the cylinder through the open unidirectional inlet reed valve. At the same time, the unidirectional exhaust reed valve is maintained in the closed position, assisted by the negative pressure created by the piston moving downward. The single poppet valve has remained open, but will close as the piston passes through BDC and the lobe of the unified camshaft moves away from the valve stem follower in advance of the compression cycle. The poppet valve will then remain closed throughout the compression cycle and the subsequent ignition (power) cycle.

ADVANTAGES

1. Reduced production costs when compared with established overhead valve arrangements using separate inlet and exhaust valves with 2 or 4 valves per cylinder. The potential for cost saving is especially significant when comparing the invention with the current 2-camshaft 4-valve arrangement.
2. Increased engine efficiency/power output, enabled by:—
   (1) Reduction of internal power losses within the engine due to the lower number of mechanically-timed components. This equates to 75% reduction in camshaft rotational losses and 75% reduction in reciprocating energy losses from valves and springs when compared with a 2-camshaft 4-valve arrangement and 50% in the case of a 2-valve arrangement.
   (2) Improved thermodynamics. The incoming fuel/air charge is pre-heated in its passage over and around the single poppet valve, due to heat previously absorbed from the passage of the outgoing exhaust gases. The single poppet valve operates at a lower temperature than a conventional exhaust valve and a higher temperature than a conventional inlet valve. This reduces thermal gradients/stresses across the cylinder head, quickens warm up and lowers emissions.
   (3) The combustion chamber valve area can be greater than the available valve area for a 4-valve arrangement.
3. Readily adaptable to existing engine technology—only the cylinder head needs to be changed.
4. Readily adaptable to different fuel types: gasoline, alcohol/gasoline blends or natural gas with spark ignition engines, and diesel or other light fuel oil with compression ignition engines.
5. Readily adaptable to new and developing fuelling technologies, such as direct injection with spirit-based fuels such as gasoline, alcohol/gasoline blends, etc, into the combustion space of spark ignition engines.
6. Reduced maintenance costs due to significant reduction in the number of internal mechanically driven components.

The invention claimed is:

1. A valve arrangement contained within a removable cylinder head for a four-cycle internal combustion engine and consisting of a single-lobe unified camshaft driven at half engine speed by a timing chain or timing belt to mechanically operate a single poppet valve to remain fully open during the inlet and exhaust strokes of the piston and remain fully closed during the compression and ignition strokes of the piston and including a passive inlet springless reed valve located in the inlet port, this being opened by the negative pressure created by the downward induction stroke of the piston to enable the inlet of air/fuel whilst drawing-in of air through the exhaust port is prevented by the closed blade of a second passive exhaust springless reed valve located within the exhaust port and held in the closed position under the negative pressure of the same downward stroke of the piston and which opens under the positive pressure created by the upward exhaust stroke of the piston to enable exhaust of the combustion gases, during which period the blade of the inlet springless reed valve located in the inlet port is held in the closed position by the positive pressure created by the same upward stroke of the piston, thus maintaining the appropriate direction of flow through the inlet and the exhaust ports.

2. A valve arrangement for an internal combustion engine according to claim 1, wherein the internal combustion engine is a said four cycle engine with a said single-lobed unified overhead camshaft located within a said removable cylinder head driven by a said timing chain or said timing belt from the crankshaft.

3. A valve arrangement for an internal combustion engine according to claim 1, wherein the internal combustion engine is a carburetted spark ignition engine wherein the blade of a uni-directional passive said inlet reed valve permits the passage of fuel and air through the inlet port under the influence of negative pressure in the combustion space.

4. A valve arrangement for an internal combustion engine according to claim 1, wherein the internal combustion engine is an indirect fuel injected spark ignition engine, wherein the blade of a uni-directional passive said inlet reed valve allows the passage of fuel and air through the inlet port under the influence of negative pressure in the combustion space.

5. A valve arrangement for an internal combustion engine according to claim 1, wherein the internal combustion engine is a high-pressure direct fuel injected (into the combustion space) spark ignition engine, wherein the blade of a uni-directional passive said inlet reed valve permits the passage of air through the inlet port under the influence of negative pressure in the combustion space.

6. A valve arrangement for an internal combustion engine according to claim 1, wherein the internal combustion engine is a compression ignition engine wherein the blade of a uni-directional passive said inlet reed valve permits the passage of air through the inlet port under the influence of negative pressure in the combustion space.

7. A valve arrangement for an internal combustion engine according to claim 1, wherein the blade of a one-piece pressure-sensitive passive said inlet reed valve located within the inlet port is orientated so as to permit the entry of air/fuel into the combustion space on the downward induction stroke of the piston.

8. A valve arrangement for an internal combustion engine according to claim 1, wherein the blade of a one-piece pressure-sensitive passive said inlet reed valve located within the inlet port is orientated so as to prevent entry of exhaust gas from the combustion space into the inlet port on the upward exhaust stroke of the piston.

9. A valve arrangement for an internal combustion engine according to claim 1, wherein the blade of a one-piece pressure-sensitive passive said exhaust reed valve located within the exhaust port is orientated so as to permit expulsion of exhaust gas from the combustion space through the exhaust port on the upward exhaust stroke of the piston.

10. A valve arrangement for an internal combustion engine according to claim 1, wherein the blade of a one-piece pressure-sensitive passive said exhaust reed valve located within the exhaust port is orientated so as to prevent re-entry of exhaust gas into the combustion space through the exhaust port on the downward induction stroke of the piston.

11. A valve arrangement for an internal combustion engine according to claim 1, wherein a said single lobe unified camshaft is located within the said cylinder head preferably, but not exclusively, above a single mechanically-timed said poppet valve.

12. A valve arrangement for an internal combustion engine according to claim 1, wherein a single mechanically-timed said poppet valve is located within the said cylinder head.

13. A valve arrangement for an internal combustion engine according to claim 1, wherein the combustion space is sealed by a single overhead mechanically-timed said poppet valve.

14. A valve arrangement for an internal combustion engine according to claim 1, wherein a said single lobe unified cam opens the said single poppet valve at the commencement of the exhaust cycle.

15. A valve arrangement for an internal combustion engine according to claim 1, wherein a said single lobe unified cam maintains a said single poppet valve in the open position throughout the duration of both the exhaust cycle and the following inlet cycle.

16. A valve arrangement for an internal combustion engine according to claim 1, wherein the said single lobe unified cam closes the said single poppet valve at the commencement of the compression cycle and maintains the said single poppet valve in the closed position throughout the following ignition cycle.

* * * * *